US005424613A

United States Patent [19]

Moriarty, Jr.

[11] Patent Number: 5,424,613

[45] Date of Patent: Jun. 13, 1995

[54] METHOD OF OPERATING A GAS-DISCHARGE LAMP AND PROTECTING SAME FROM OVERLOAD

[75] Inventor: John K. Moriarty, Jr., Reading, Pa.

[73] Assignee: AT&T Corp., Murray Hill, N.J.

[21] Appl. No.: 171,501

[22] Filed: Dec. 22, 1993

[51] Int. Cl.[6] ..... H05B 37/02

[52] U.S. Cl. ..... 315/209 R; 315/106; 315/224; 315/307; 315/DIG. 5; 315/DIG. 7

[58] Field of Search ..... 315/94, 106, 307, 200 R, 315/209 R, 224, DIG. 5, DIG. 7

[56] References Cited

U.S. PATENT DOCUMENTS

| | | | |
|---|---|---|---|
| 4,949,013 | 8/1990 | Zuchtriegel | 315/106 |
| 4,952,842 | 8/1990 | Bolhius et al. | 315/106 |
| 5,049,790 | 9/1991 | Herfurth et al. | 315/DIG. 4 X |
| 5,122,712 | 6/1992 | Hirschmann | 315/106 |

OTHER PUBLICATIONS

"Telefunken Application Note", (Date Unknown) pp. 1 through 6.

"Electronic Ballasts", *PCIM*, Apr. 1987, R. J. Haver, Motorola, Inc., pp. 52 through 56 and 58.

"International Rectifier Application Note 973", (Date Unknown) Peter N. Wood, pp. 229 through 236.

"1.9 Electronic ballast for flourescent lamps", Siemens (?), (Date Unknown) p. 34.

*Primary Examiner*—Robert J. Pascal
*Assistant Examiner*—Haissa Philogene
*Attorney, Agent, or Firm*—Scott W. McLellan

[57] ABSTRACT

A gas-discharge lighting system having an inductor and at least two capacitors in combination with a gas discharge lamp, the inductor and capacitors forming a resonant system, the resonant frequency thereof being dependent upon whether the lamp is nonionized or ionized. The lamp is operated by driving the lamp, inductor, and capacitor combination with a signal of a first polarity and inverting the polarity when the signal current transitions a predetermined current level. This repeated until the polarity of the signal remains of one polarity longer than a predetermined time, at which time the signal is inverted. This is repeated indefinitely. The predetermined length of time is one-half the inverse of a minimum frequency greater than the ionized resonant frequency. To protect the lighting system from overload, if the signal current exceeds a predetermined level, then the polarity of the signal is inverted, effectively moving the frequency of the signal up away from the ionized resonant frequency, thereby reducing the power delivered to the lamp. This method is applicable to fluorescence lighting and other gas-discharge lamps, such as mercury and sodium vapor lamps.

7 Claims, 2 Drawing Sheets

METHOD OF OPERATING A GAS-DISCHARGE LAMP AND PROTECTING SAME FROM OVERLOAD

BACKGROUND OF THE INVENTION

CROSS-REFERENCE TO RELATED APPLICATION

This application is related to a co-pending patent application titled "Method for Pre-Heating a Gas-Discharge Lamp", by J. K. Moriarty, Ser. No., 08/173,363, filed simultaneously with, and assigned to the same assignee, as this application.

1. Field of the Invention

This invention relates to ballasts for gas discharge lamps and the like and, more particularly, to electronic ballast circuits for driving gas-discharge lamps.

2. Description of the Prior Art

Gas discharge lighting, such as sodium vapor or fluorescence lighting, is used where the higher efficiency of gas discharge lighting over incandescent lighting is important, such as in office buildings where there may be thousands of lighting fixtures.

Each gas discharge lighting fixture or system has a ballast which controls the operation of one or more gas discharge lamp therein. The ballast serves to provide the correct voltage and current to the lamp when the fixture is first turned on and thereafter. The ballast is recognized as the component most needing improvement to increase the efficiency of gas discharge lighting.

The initial ballast designs were large transformers that operated at the power line frequency (e.g., 50 or 60 Hz) and were heavy and dissipated a lot of power. These were replaced with electronic ballasts that still relied on transformers but operated at higher frequencies (tens of KHz) to achieve better efficiencies, reduced weight and size (the transformers could be much smaller when operated at the higher frequencies). However, the transformers reduce the efficiency of the ballast. Moreover, transformer-based electronic ballast are difficult to design, relying on the electromagnetic properties of the transformer to achieve the desired voltage and current to the gas discharge lamp on startup and thereafter. Usually, these designs are a compromise between the startup and operating voltages/currents, leading to the possible reduction the life of the gas discharge lamp and/or efficiency reduction of the overall lighting system.

Thus, it is desirable to provide a ballast design that has better efficiency that prior art ballast designs.

Further, it is desirable to provide a ballast design that can be adjusted to provide the desired voltages/currents to the gas discharge lamp depending upon the level of ionization in the lamp.

Still further, it is desirable to provide an electronic ballast design with a safety feature to protect the ballast and gas discharge lamp when an overload occurs.

SUMMARY OF THE INVENTION

These and other aspects of the invention are generally provided for by a method of driving a gas-discharge lamp in a lighting system, the system having an inductor and at least two capacitors in combination with a gas discharge lamp, the inductor and capacitors forming a resonant system, the resonant frequency thereof being dependent upon whether the lamp is ionized or not. The lamp is operated using the steps of: driving the lamp, inductor, and capacitor combination with a signal of a first polarity; measuring the signal current; and inverting the polarity of the signal when the current transitions a predetermined current level. The steps of measuring the signal current and inverting the polarity of the signal when the current transitions are repeated indefinitely. If, during the repeating of the above two steps, the signal remains of one polarity for longer than a predetermined length of time, then the polarity of the signal is inverted. The predetermined length of time is one-half the inverse of a minimum frequency greater than the ionized resonant frequency but less than the nonionized resonant frequency.

The above aspects of the invention may also be generally obtained in protecting from overload a gas discharge lighting system, as described above, by the steps of: driving the lamp, inductor, and capacitor combination with a signal of a first frequency different from the resonant frequency by a predetermined amount; measuring the signal current; and shifting the first frequency away from the resonant frequency by an amount greater than the predetermined amount if the lamp current exceeds a predetermined current.

BRIEF DESCRIPTION OF THE DRAWING

The foregoing features of this invention, as well as the invention itself, may be more fully understood from the following detailed description of the drawings, in which.

DETAILED DESCRIPTION

For the foregoing discussion, fluorescence lamps are used in the exemplary embodiments of the invention. It is understood that the invention is applicable to gas discharge lamps in general, such as mercury and sodium vapor lamps, and equal to all ones of such lamps.

Figure 1:
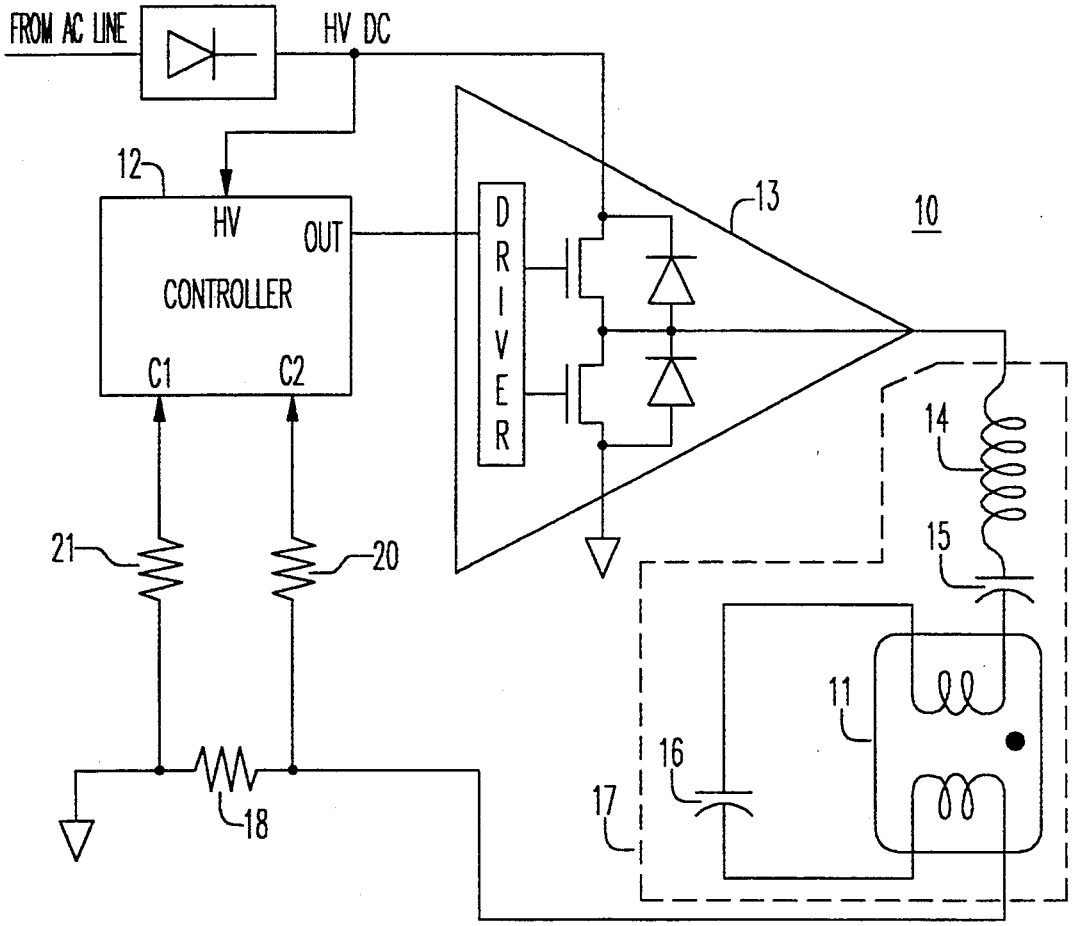
FIG. 1 is a simplified diagram of an exemplary gas-discharge lighting system having a controller in accordance with an embodiment of the invention.

Referring to FIG. 1, an exemplary gas-discharge lighting system 10 is diagramed. In general, the system 10 can be thought of as a lamp 11 and the remaining circuitry being what is commonly known as a ballast (not numbered), here an electronic ballast. In this exemplary embodiment, the system 10 has a controller 12 with a power amplifier 13 driving a combination of an inductor 14, two capacitors 15, 16 and the lamp 11. The capacitors 15, 16 and inductor 14 are disposed in series with the filaments (not numbered) within lamp 11. This allows the combination of lamp 11, capacitors 15, 16 and inductor 14 to form a resonant circuit 17, the resonant frequency of which dependent upon whether the lamp is ionized (hot) or nonionized (cold). For purposes here, the capacitance of capacitor 15 is much larger than the capacitance of capacitor 16 such that when the lamp 11 is nonionized, the resonant frequency is substantially determined by the capacitor 16 and inductor 14. When the lamp 11 is ionized, substantially all the current is flowing between the filaments in lamp 11, effectively shunting capacitor 16. Thus, as the lamp 11 warms up, the resonant frequency shifts downward from the nonionized resonant frequency to an ionized resonant frequency substantially set by inductor 14 and capacitor 15. The Q of the resonant circuit 17 also varies depending on the ionization level of the lamp 11. When the lamp 11 is nonionized, the Q is high (the filaments have relatively low resistances) and when the lamp is ionized, the Q is lowered. This makes it more critical to control the frequency of a signal from the power amplifier 13 when the lamp 11 is nonionized so that enough power is transferred to the lamp 11 to start it, as will be described below. It is also critical to not drive the resonant circuit 17 at resonance at any time. Thus, the frequency of the signal from the power amplifier 13 is controlled to avoid operating at resonance.

Generally and for purposes of describing the invention, this invention describes an exemplary method of driving of the resonant circuit 17 with a signal from the power amplifier 13. When the system 10 is first started, the signal has a frequency approximately equal to the nonionized resonance frequency. As the lamp 11 ionizes, the signal frequency sweeps toward the ionized resonant frequency until reaching a predetermined frequency differing from the ionized resonant frequency. By limiting the signal frequency to above the ionized resonant frequency, the power delivered to the lamp is limited. Additionally, by increasing the signal frequency, the amount of power delivered to the lamp 11 decreases, useful in dimming applications. Still further, if an overload condition occurs in the resonant circuit (in this example when the amount of current in the lamp 11 exceeds a predetermined amount), the signal frequency is increased, thereby protecting the lighting system 10 from damage.

In more detail, the controller 12 provides a signal that is amplified by power amplifier 13 to drive the resonant circuit 17. The controller 12 will be discussed in more detail below, but it is sufficient for purposes here that the controller measures the current in the lamp 11 (the current from the resonant circuit 17) by evaluating the voltage drop across series resistor 18. In essence, the controller acts as a relaxation oscillator. A signal of a first polarity from the controller 12 is amplified by power amplifier 13 and applied to the resonant circuit 17. When the current through resistor 18 transitions a predetermined level of current with the right slope, the controller inverts the signal. This is repeated, forming an oscillation. (While the process of detecting a transition of a predetermined current level by the lamp 11 current with the right slope is discussed in detail below, for purposes of this discussion it is detecting when the lamp 11 current transitions a predetermined current level having a polarity opposite the polarity of the slope of the lamp 11 current at the time of the transition.) When the lamp 11 is nonionized, the oscillation frequency is near the nonionized resonance frequency of the resonant circuit 17, as discussed above.

As the lamp 11 ionizes more fully from the cold (nonionized) start, the amount of time for the current in the lamp 11 to transition the predetermined current level lengthens. This makes the oscillation frequency shift downward until a maximum time between changes in signal polarity occurs (referred to here as a time-out), setting the minimum oscillation frequency. This minimum frequency is set to be greater than the ionized resonant frequency of the resonant circuit 17. Thus, the maximum possible energy transfer from the power amplifier 13 to the lamp 11 can be avoided.

It is noted that by shifting the oscillation frequency up further away from the resonant frequency, less energy is transferred from the power amplifier 13 to the lamp 11. If a fault is detected by the controller 12 as indicated by the current in the lamp 11 exceeding a predetermined amount (an overload), the polarity of the signal from the controller 11 changes polarity. Since, during normal operation, the overload current limit is not reached at the minimum oscillation frequency, the detection of an overload condition occurs before the time-out, thus causing the oscillation frequency to increase away from the resonant frequency of the resonant circuit 17. As discussed above, this reduces the power delivered to the lamp 11, protecting it and the amplifier 13 from damage during an overload.

Amplifier 13 is shown having two output transistors and a driver (not numbered). While detailed understanding is not important for understanding the invention, the amplifier 13 will be described here simply. For purposes here, the driver assures that both output transistors are not on at the same time; a dead time is forced between the on time of the transistors. To minimize power dissipation in the output transistors, the transistors are switched on when the drain-source voltage of the transistor is near zero volts, known as zero voltage switching. The amplifier 13 is powered from a high voltage DC bus (HV DC) that derives its voltage from the AC power line, making the amplitude of the signal from the amplifier 13 proportional to the voltage on the HV DC bus. As will be discussed below, the power delivered to the lamp 11 is proportional to the signal amplitude and, without compensation, the light output of the lamp will change with varying AC line voltage.

Figure 2:
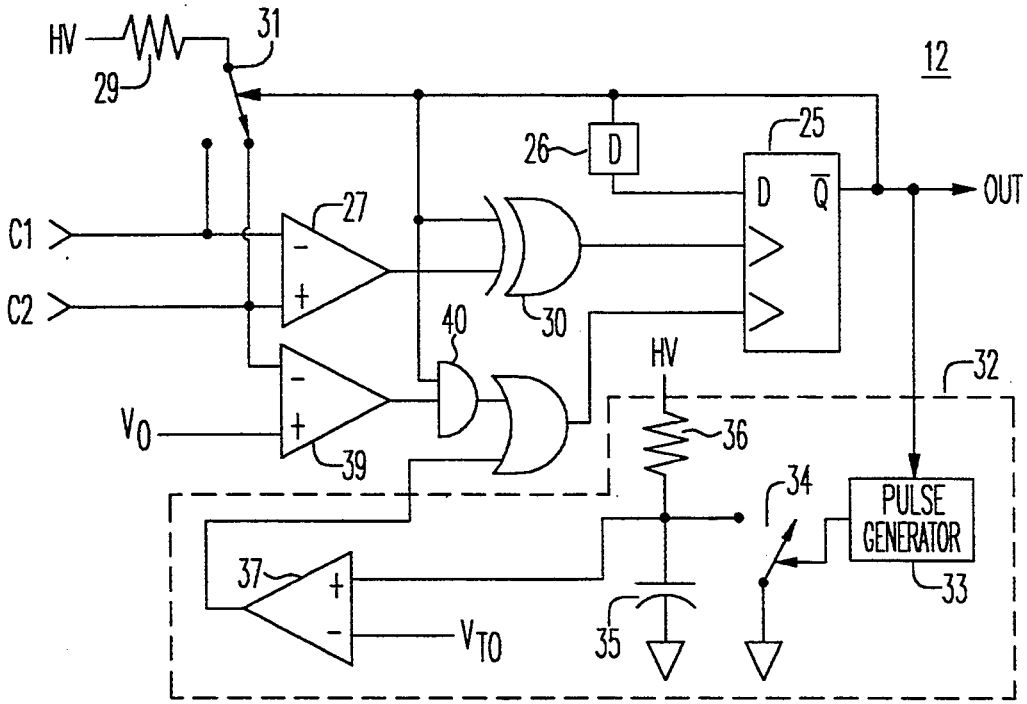
FIG. 2 is a simplified schematic diagram of the controller shown in FIG. 1 in accordance with the embodiment of the invention.

Shown in FIG. 2 is an exemplary and simplified circuit diagram of the controller 12 (FIG. 1). At the core of the controller 12, a clocked flip-flop 25 generates a signal that drives power amplifier 13 (FIG. 1). Each time the flip-flop 25 is clocked, the output ($\overline{Q}$) thereof is inverted (toggled). To avoid multiple transitions in the output of the flip-flop 25 due to "bounce" in the clock signal source, a delay 26 is provided between the $\overline{Q}$ output and the D input of the flip-flop 25. The amount of delay is sufficient to assure that the clock signal to the flip-flop 25 has stabilized before the D input receives a new value.

Flip-flop 25 is clocked from one of three sources depending on the operational state of the lighting system 10 (FIG. 1). During the start-up state, as discussed above, comparator 27 clocks the flip-flop 25 when the current through the lamp 11 (FIG. 1) passes through a predetermined current level, as sensed across current sensing resistor 18 (FIG. 1). Resistor 29 adds an offset current into the resistors 18, 20, 21 (FIG. 1) to establish the level of voltage across resistor 18 that will switch the comparator 27, i.e., resistor 29, in combination with resistors 18, 20 and 21, substantially determines the switching current level in the lamp 11. Exclusive OR (EX-OR) gate 30 and switch 31 invert the output of the comparator 27 and redirects the offset current from resistor 29 into the comparator 27 input, respectively, for clocking the flip-flop 25 for both positive and negative lamp current transition polarities. The flip-flop 25, delay 26, EX-OR gate 30 and comparator 27 cooperate to emulate a window comparator such that flip-flop 25 toggles when the polarity of the slope of the voltage across resistor 18 is opposite the polarity of the desired threshold voltage at the time-the voltages are approximately the same, as described above.

Figure 3:
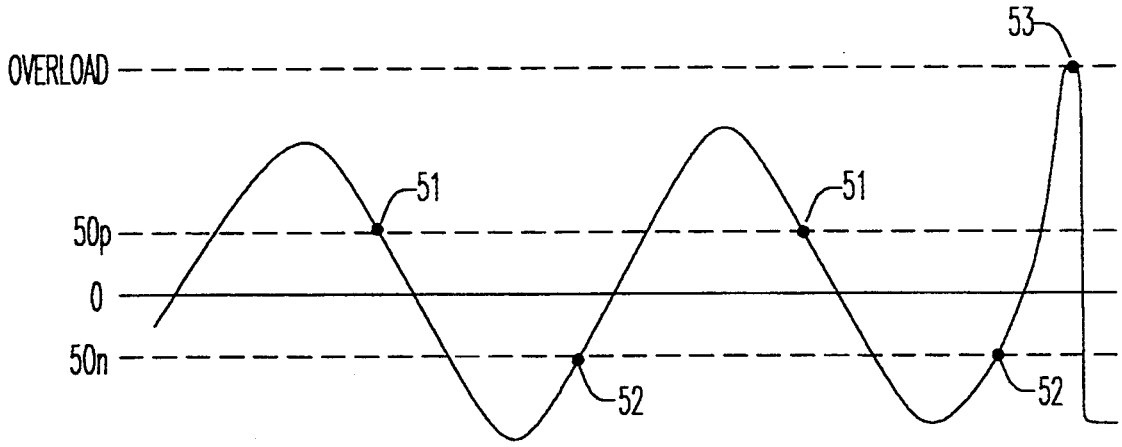
FIG. 3 is a simplified plot (not to scale) of the current in the gas-discharge lamp of FIG. 1 during start-up of the lamp.

Operationally, the flip-flop 25 outputs a first polarity signal which, after amplification by power amplifier 13, the current through the lamp 11 increases until the voltage drop across resistor 18 with the correct slope transitions a value determined by resistor 20 or 21 (depending on the position of switch 31) and resistor 29, switching the output of comparator 27. This, in turn, toggles flip-flop 25 and the above process repeats. This is illustrated in FIG. 3. The depicted waveform is an illustrative example of the current in the lamp 11 as represented by voltage across resistor 18 (the real waveform is more complicated but it is sufficient here that the waveform be depicted sinusoid-like). As shown, the current in lamp 11 (and then 18) voltage across resistor 18 is symmetric about zero (0) and exceeds the thresholds 50*p*, 50*n*, illustrating the operation of the lamp system 10 (FIG. 1) in the start-up mode. As the waveform slopes negatively, the positive threshold 50*p* is transitions at point 51, toggling flip-flop 25 (FIG. 2). Similarly, when the waveform slope is positive, the negative threshold 50*n* is transitioned at point 52, again toggling flip-flop 25. By virtue of the resonant circuit 17 (FIG. 1), the current in the lamp 11 continues to extend beyond the thresholds 50*p* and 50*n*. Because of this and the window comparison function of the comparator 27, gate 30 and flip-flop 25 combination, the closer to zero the thresholds are, the more the peak current in the lamp 11 becomes and, conversely, the higher the thresholds, the less the peak current in lamp 11. By making the threshold voltage 50*p*, 50*n* dependent on the HV bus voltage (via resistor 29 as shown in FIG. 2), the power delivered to the lamp 11 is less dependent upon the HV bus voltage during startup than if the threshold voltage were fixed.

Returning to FIG. 2 and as discussed above, during normal operation of the lighting system 10 after start-up, output of the controller 12 changes without intervention by comparator 27 by means is time-out circuit 32. Circuit 32 assures that the flip-flop 25 is toggled at a minimum rate or frequency as substantially established by the delay period of the time-out circuit 32. Time-out circuit 32 utilizes a combination of a pulse generator 33, capacitor 35, resistor 36 and a comparator 37 to set the delay thereof. The pulse generator 33 generates a short pulse to close switch 34 each time flip-flop 25 toggles. Switch 34 discharges capacitor 35 to start the time-out delay period. As current from resistor 36 charges capacitor 35, voltage on capacitor 35 increases until a predetermined voltage is reached thereon, triggering comparator 37 to toggle flip-flop 25. The predetermined voltage is substantially equal to $V_{TO}$. Thus, the time-out delay period is substantially determined by the values of capacitor 35, resistor 36, the time-out trigger voltage $V_{TO}$, and the voltage of the high voltage power supply rail, HV. Because the current from the resistor 36 is dependent upon the voltage on the high-voltage rail, as the voltage increases, the time-out delay period decreases. To compensate for an increased signal level from amplifier 13 as the AC line voltage increases, as discussed above, the signal to the lamp 11 increases in frequency away from the resonant frequency of the resonant circuit 17 (HG. 1). Similarly, the frequency decreases as the AC line voltage decreases. Thus, the power delivered to the lamp 11 remains substantially the same with varying line voltage.

It is understood that resistor 36 may be coupled to a fixed voltage supply instead of the HV bus if the variable time-out delay feature is not desired.

Comparator 39, ORed together with the output of the time-out circuit 32, clocks flip-flop 25 if the voltage of input C2 exceeds $V_O$. Comparator 39 serves as the overload detector in combination with resistor 18. If the offset current from resistor 29 were allowed to flow through resistor 20 (FIG. 1), then the current limit sensing would be corrupted. Hence, AND gate 40 enables the output of comparator 30 when the output of flip-flop 25 configures switch 31 to couple resistor 29 to resistor 21. If the current in lamp 11 (as shown on FIG. 3) exceeds the OVERLOAD current limit (53), then the flip-flop 25 is immediately toggled. This has the effect of raising the frequency of the lamp 11 current, decreasing the power delivered to lamp 11, as described above. It is noted that comparator 39 may be a simple bipolar transistor, making $V_o$ about 0.7 volts.

EXEMPLARY EMBODIMENT

The lighting system 10 of FIGS. 1 and 2 have been reduced to practice in a 30 watt fluorescent light using the following component values:

| | |
|---|---|
| inductor 14 | 500 μH |
| capacitor 15 | 100 nF |
| capacitor 16 | 10 nF |
| resistor 18 | 0.5 Ω |
| resistors 20, 21 | 1000 Ω |
| resistor 29 | 1 MΩ |
| time-out delay | 12 μs. |
| HV bus | 150 V. |
| overload current limit | 1.5 A. |
| threshold current limit 50p, 50n | 200 mA. |

Having described the preferred embodiment of this invention, it will now be apparent to one of skill in the an that other embodiments incorporating its concept may be used. Therefore, this invention should not be limited to the disclosed embodiment, but rather should be limited only by the spirit and scope of the appended claims.

I claim:

1. A method of operating gas discharge lighting system having an inductor and at least two capacitors in combination with a gas discharge lamp, the inductor and capacitors forming a resonant system, the resonant frequency thereof being dependent upon whether the lamp is nonionized or ionized, characterized by the steps of:

A) driving the lamp, inductor, and capacitor combination with a signal, of a first polarity;

B) measuring the current of the signal;

C) inverting the polarity of the signal when the signal current transitions a predetermined current level;

D) repeating steps B and C;

wherein if the signal remains of one polarity for longer than a predetermined length of time, the polarity of the signal is inverted; and wherein the predetermined length of time is one-half the inverse of a minimum frequency greater than the ionized resonant frequency but less than the nonionized resonant frequency.

2. The method as recited in claim 1, wherein the polarity of the signal is inverted when the polarity of the slope of the signal current is opposite the polarity of the predetermined current level at the transition of same by the signal current.

3. The method as recited in claim 2, wherein the signal is provided by a ballast that is coupled to a power supply and the predetermined length of time is an direct function of the power supply voltage.

4. The method as recited in claim 3, wherein the direct function is chosen such that the lamp power is substantially invariant with changes in the power supply voltage.

5. A method of protecting from overload a gas discharge lighting system having an inductor and at least two capacitors in combination with a gas discharge lamp, the inductor and capacitors forming a resonant system having a resonant frequency, characterized by the steps of:

driving the lamp, inductor, and capacitor combination with a signal of a first frequency different from the resonant frequency by a predetermined amount;

measuring the current of the signal;

shifting the first frequency away from the resonant frequency by an amount greater than the predetermined amount if the lamp current exceeds a predetermined current.

6. The method as recited in claim 5, wherein the first frequency is higher than the resonant frequency and the shift in the first frequency is to a higher frequency.

7. A method of protecting from overload a gas discharge lighting system having an inductor and at least two capacitors in combination with a gas discharge lamp, the inductor and capacitors forming a resonant system having a resonant frequency, characterized by the steps of:

A) driving the lamp, inductor, and capacitor combination with a signal of a first polarity;

B) measuring the current of the signal;

C) inverting the polarity of the signal when the current exceeds a predetermined current level or the signal remains of the polarity for longer than a predetermined length of time;

D) repeating steps B and C;

wherein the predetermined current level is chosen such that during normal operation of the system, the current in the lamp does not reach the predetermined level unless an overload condition exists; and wherein the predetermined length of time is one-half the inverse of a minimum frequency greater than the resonant frequency.

* * * * *